US006810229B2

(12) United States Patent
Coleman et al.

(10) Patent No.: US 6,810,229 B2
(45) Date of Patent: Oct. 26, 2004

(54) NON-CONTACT FUSING ROLLER/MEDIA SEPARATION APPARATUS AND METHOD FOR ITS USE

(75) Inventors: Larry Christopher Coleman, Lexington, KY (US); Samuel Winton Holmes, Jr., Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 9 days.

(21) Appl. No.: 10/331,519

(22) Filed: Dec. 30, 2002

(65) Prior Publication Data

US 2004/0126157 A1 Jul. 1, 2004

(51) Int. Cl.[7] ..... G03G 15/20
(52) U.S. Cl. ..... 399/323
(58) Field of Search ..... 399/328, 330, 399/320, 322, 323; 219/216, 469, 470, 471

(56) References Cited

U.S. PATENT DOCUMENTS 3,998,584 A * 12/1976 Wada et al. ..... 219/469
4,281,623 A * 8/1981 Kato et al. ..... 219/216
RE33,844 E 3/1992 Koizumi et al.
5,319,430 A * 6/1994 DeBolt et al. ..... 399/322
6,173,151 B1 * 1/2001 Ream et al. ..... 399/322
6,236,829 B1 * 5/2001 Uehara et al.
6,678,497 B1 * 1/2004 Murata

FOREIGN PATENT DOCUMENTS

JP 2001056619 A * 2/2001 ..... G03G/15/20
JP 2002082563 A * 3/2002 ..... G03G/15/20
JP 2002311740 A * 10/2002 ..... G03G/15/20

* cited by examiner

*Primary Examiner*—Susan Lee
(74) *Attorney, Agent, or Firm*—Frederick H. Gribbell, LLC; John A. Brady

(57) ABSTRACT

An improved fuser subassembly is provided for electrophotographic printers, in which the detack fingers that separate print media from the fuser hot roll do not make physical contact with that hot roll, and thus are "non-contact" detack fingers. A maximum clearance distance is observed as a relatively tight tolerance between the surface of the hot roll and the tip of the non-contact detack fingers. Both color and mono laser printer products can benefit from this design. Since the finger tips are spaced-apart from the fuser hot roll, the life of the hot roll is increased, and other potential problems are eliminated, such as contamination of the detack fingers, which sometimes cause accordion jams of prior art "contact" detack fingers.

28 Claims, 13 Drawing Sheets

NON-CONTACT FUSING ROLLER/MEDIA SEPARATION APPARATUS AND METHOD FOR ITS USE

TECHNICAL FIELD

The present invention relates generally to image forming equipment and is particularly directed to electrophotographic printers of the type which use a fuser hot roll to affix toner to a print media. The invention is specifically disclosed as a non-contact detack arrangement that separates the print media from the fuser hot roll, in which the detack fingers do not physically touch the hot roll.

BACKGROUND OF THE INVENTION

In a typical electrophotographic printing process, toner is fused to the print media in the fusing station of the machine. The fusing station in desktop printers is normally composed of a heated, fluoropolymer-coated aluminum fusing roll, a soft elastomeric pressure roll, and a means to apply pressure between the two rolls. The combined action of heat, pressure, and dwell time in the nip formed between the two rolls causes the thermoplastic toner to soften and flow between the media fibers. Upon cooling the toner solidifies and is firmly affixed to the media.

During the fusing process, the toner can adhere to the fusing roll under certain conditions. In conventional printers the adhesion of the toner (and subsequently the media) to the fusing roll during the fusing process is alleviated by a media/roller separation mechanism that is in contact with the fusing roll. This separation mechanism (herein referred to as "contact" detack fingers) consists of spring loaded fingers that are in contact with the fusing roll. FIG. 1 shows a conventional media/roller separation mechanism that is used in conventional Lexmark printer products. Please note that in FIG. 1 several fuser components are omitted for clarity.

In FIG. 1, a fuser hot roll is generally designated by the reference numeral 1, and is mounted into a fuser frame 3 by use of bearings 7. The print media (not shown) travels between a nip (not shown) between the fuser hot roll 1 and a pressure roll (not shown), and exits this nip through a second nip between a first exit roller 4 and a second exit roller 5. Exit rollers 4 and 5 are typically rotated at a somewhat greater linear velocity so as to produce a slight tension on the print media. This is also referred to as an "overdrive" configuration.

FIG. 1 also illustrates several contact detack finger subassemblies at the reference numerals 2. These "fingers" are better illustrated in FIG. 2, and make actual contact with the fuser hot roll 1.

FIG. 2 is another view of the conventional printer mechanism illustrated in FIG. 1. In FIG. 2, several fuser components are also omitted for clarity, including the fuser hot roll itself. The fuser bearing 7 is still illustrated, and is attached to the side bracket of the fuser frame 3. The pressure roll (sometimes referred to as a "backup roll") is generally designated at the reference numeral 8. The contact detack finger subassemblies 2 are shown in greater detail in FIG. 2, and the actual finger extension of these subassemblies 2 is illustrated at the reference numeral 6. As can be seen, the extension at 6 is the actual "finger" or structure that makes contact via a spring-loaded mechanism with the fuser hot roll.

Although the contact detack fingers 6 accomplish their original design intent of stripping media off of the fusing roll

1, their frictional contact design has many disadvantages, namely fuser roll wear as well as acting as a toner collection site. As the fuser gets late in life, the frictional contact of the detack fingers 6 will wear the fuser roll 1 in the contact areas such that aluminum becomes exposed on the fluoropolymer coated fusing roll 1. The exposed aluminum will cause a print defect (e.g., vertical streaking), because toner has a tendency to stick to the exposed aluminum of the fusing roll. The detack fingers 6 also act as a collection site for unfused toner (because the fusing process is not 100% efficient and some toner stays on the fusing roll and not the media). The buildup of toner on the contact detack fingers can at times cause a very blunt tip of the conventional detack finger 6 thereby defeating the original design intent. The toner buildup can result in unnecessary fuser jams, or in toner being deposited onto the page after a threshold of toner has been accumulated on the detack tip, and then is released.

It would be an advantage to alleviate the faults caused by the conventional contact-type system of detack fingers by replacing these contact-type fingers with a non-contact system that nevertheless separates the print media from the fuser hot roll.

SUMMARY OF THE INVENTION

Accordingly, it is an advantage of the present invention to provide a fuser hot roll for an electrophotographic printer that does not use contact-type detack fingers, but instead uses a non-contact detack finger system that involves tight clearances that are maintained between a fuser hot roll and the non-contact detack fingers.

It is another advantage of the present invention to provide a set of non-contact detack fingers that are spaced-apart from the fuser hot roll by accurately controlling the top margin of the print media in conjunction with the non-contact detack clearance, which both reduces the cost of the printer fuser subassembly, and also creates a system that is more reliable by helping to avoid problems such as degraded print quality when the fuser becomes old, and also avoids jams that otherwise may occur with conventional contact detack fingers that have a buildup of toner.

It is a further advantage of the present invention to provide an electrophotographic (EP) printer with a non-contact detack finger system, in which a relatively tight locational/tolerance control of a non-contact detack housing is improved by use of a straightening rod and a locating technique that guarantees that a specified maximum clearance specification is not exceeded.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an image forming fuser apparatus is provided, which comprises: a fuser hot roll and a pressure roll, wherein the fuser hot roll and the pressure roll form a nip therebetween; and a detack structure that is spaced-apart from the fuser hot roll, the detack structure comprising at least one extension proximal to the fuser hot roll such that a clearance gap is formed between the at least one proximal extension and the fuser hot roll; wherein the detack structure is positioned so as to ensure separation of a print media from the fuser hot roll after the print media travels through the nip, by use of the at least one proximal extension.

In accordance with another aspect of the present invention, an image forming fuser apparatus is provided, comprising: a fuser hot roll and a pressure roll, wherein the fuser hot roll and the pressure roll form a nip therebetween; and a detack structure that is spaced-apart from the fuser hot roll, such that a clearance gap is formed therebetween; wherein the detack structure is positioned such that the clearance gap exhibits a predetermined maximum distance, thereby ensuring separation of a print media from the fuser hot roll after the print media travels through the nip.

In accordance with yet another aspect of the present invention, a method for separating a print media from a fuser hot roll in an image forming apparatus is provided, in which the method comprises the following steps: providing a fuser hot roll and a pressure roll, wherein the fuser hot roll and the pressure roll form a nip therebetween; directing a print media through the nip while rotating the fuser hot roll and the pressure roll; and separating the print media from the fuser hot roll by use of a non-contact detack structure, while maintaining a clearance gap within a predetermined maximum distance between the non-contact detack and the fuser hot roll.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
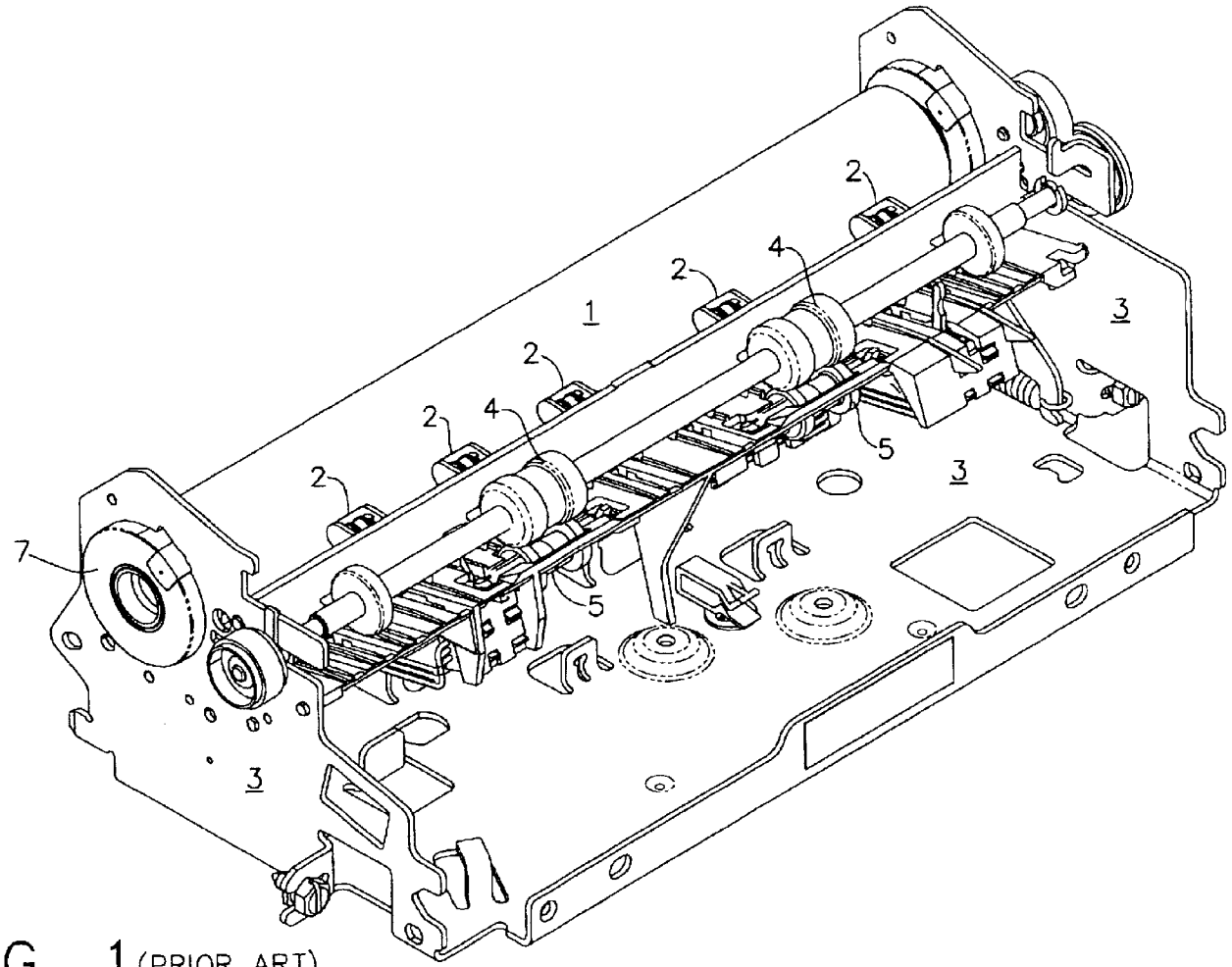
FIG. 1 (PRIOR ART)
FIG. 1 is a perspective view of a portion of a fuser subassembly from above, one side, and from the exiting end, of a prior art electrophotographic printer fusing station.
Figure 2:
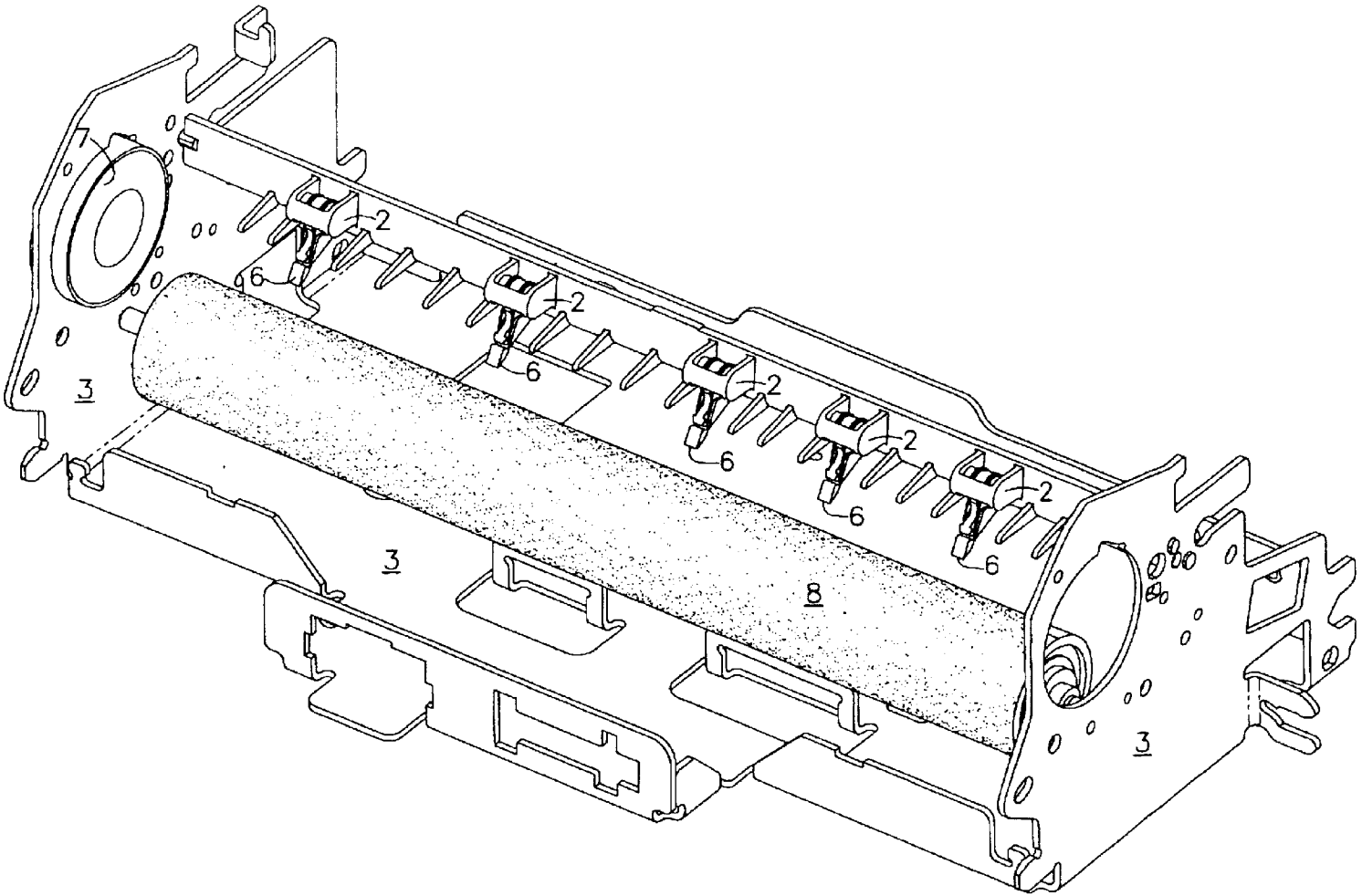
FIG. 2 (PRIOR ART)
FIG. 2 is a perspective view of the prior art fusing station of FIG. 1 from the opposite or entry end of the fusing station, which shows the conventional "contact" detack fingers.
Figure 3:
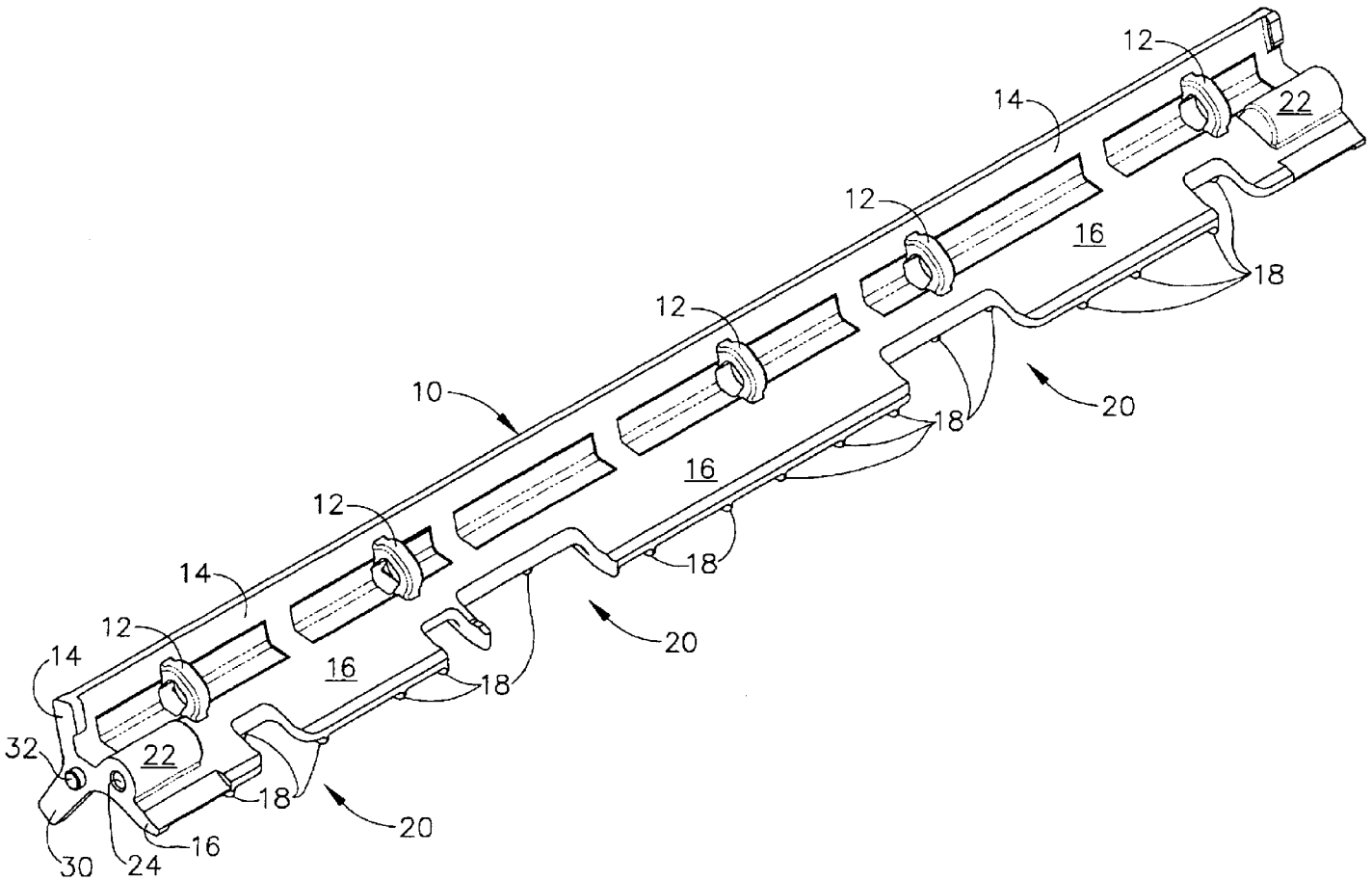
FIG. 3 is a perspective view from above and one end of a non-contact detack housing of a first embodiment of the present invention.

Referring now to FIG. 3, a non-contact detack housing is illustrated, generally referred to by the reference numeral 10. As can be seen at the lower left end (as viewed in FIG. 3), detack housing 10 has an overall "Y"-shape when viewed from its left end. The main leg of this Y-shape is a member 30, while the upper-left arm is a member 14, and the upper-right arm is a member 16. An angle is formed between the upper arm members 14 and 16, and there are a series of positioning loops 12 that act as constraints for a straightening arm (not shown on FIG. 3) that will be inserted to both strengthen and straighten the detack housing 10.

Figure 6:
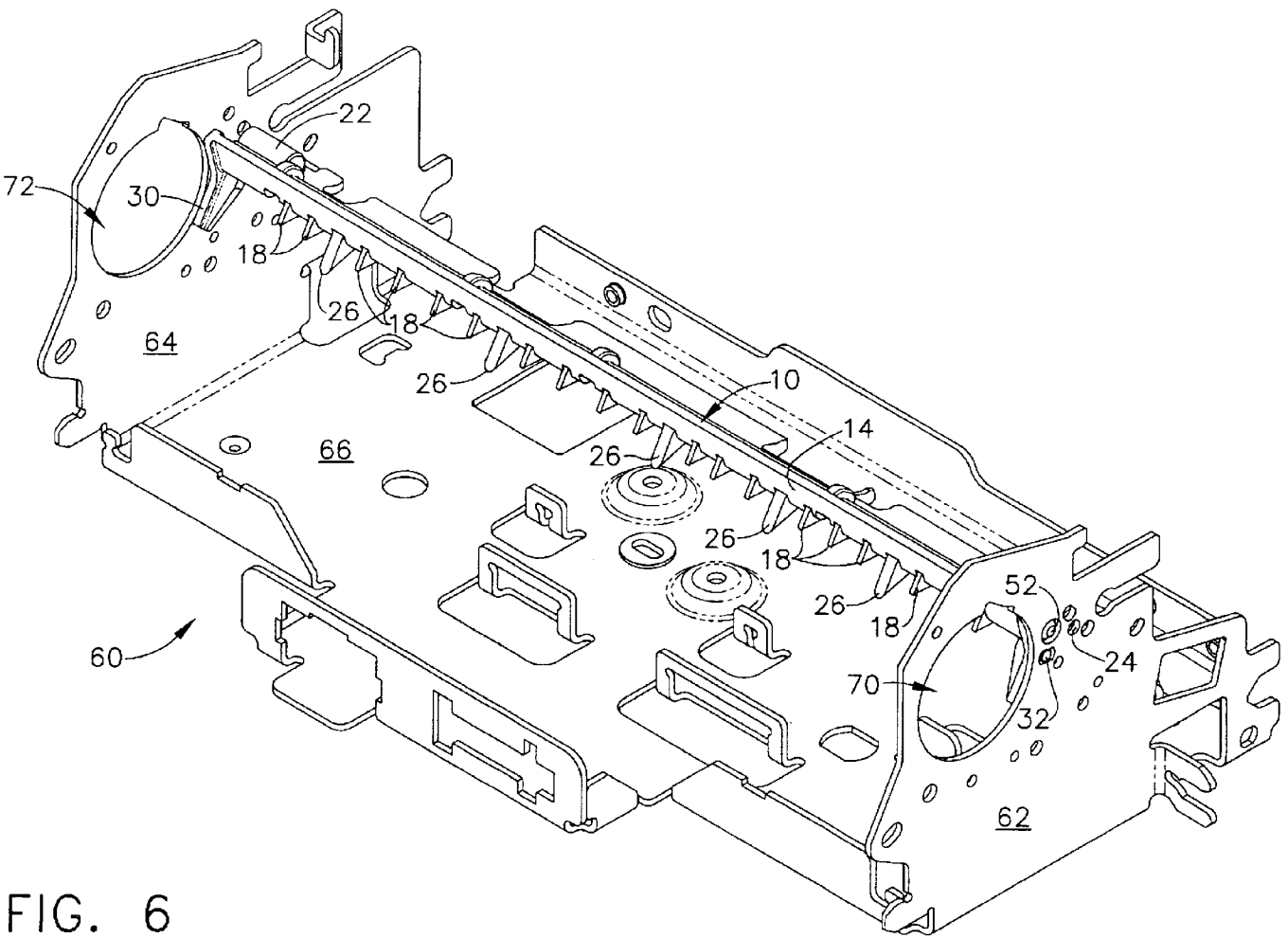
FIG. 6 is a perspective view from above and from the same side, but from the entry end of the fusing station of the fuser subassembly of FIG. 5.

The actual "finger" shape of detack housing 10 is not visible on FIG. 3, but is clearly illustrated on FIG. 6. On FIG. 3, more details of the member 16 are visible, including a set of ribs 18 that are spaced apart from one another along the bottom surface (as seen in FIG. 3) of member 16. The print media will slide along this bottom surface of the ribs 18 as it exits the nip between the fuser hot roll and the pressure roll. Another feature of member 16 is a set of "cut-outs" (i.e., openings) that are formed during the manufacturing process of the detack housing, and these cut-outs are illustrated at the reference numerals 20. In general, the openings 20 are made to allow for a close positioning of the exit rollers (not shown on FIG. 3). The term "cut-out" is really a misnomer, because the detack housing is designed to be formed by plastic injection molding, in which case all of the shapes of the member 16 will be formed at one time, and no machining or other type of material removal operation need be performed. The precise shape of this edge of the housing member 16 is not functional to the operation of the present invention.

Figure 8:
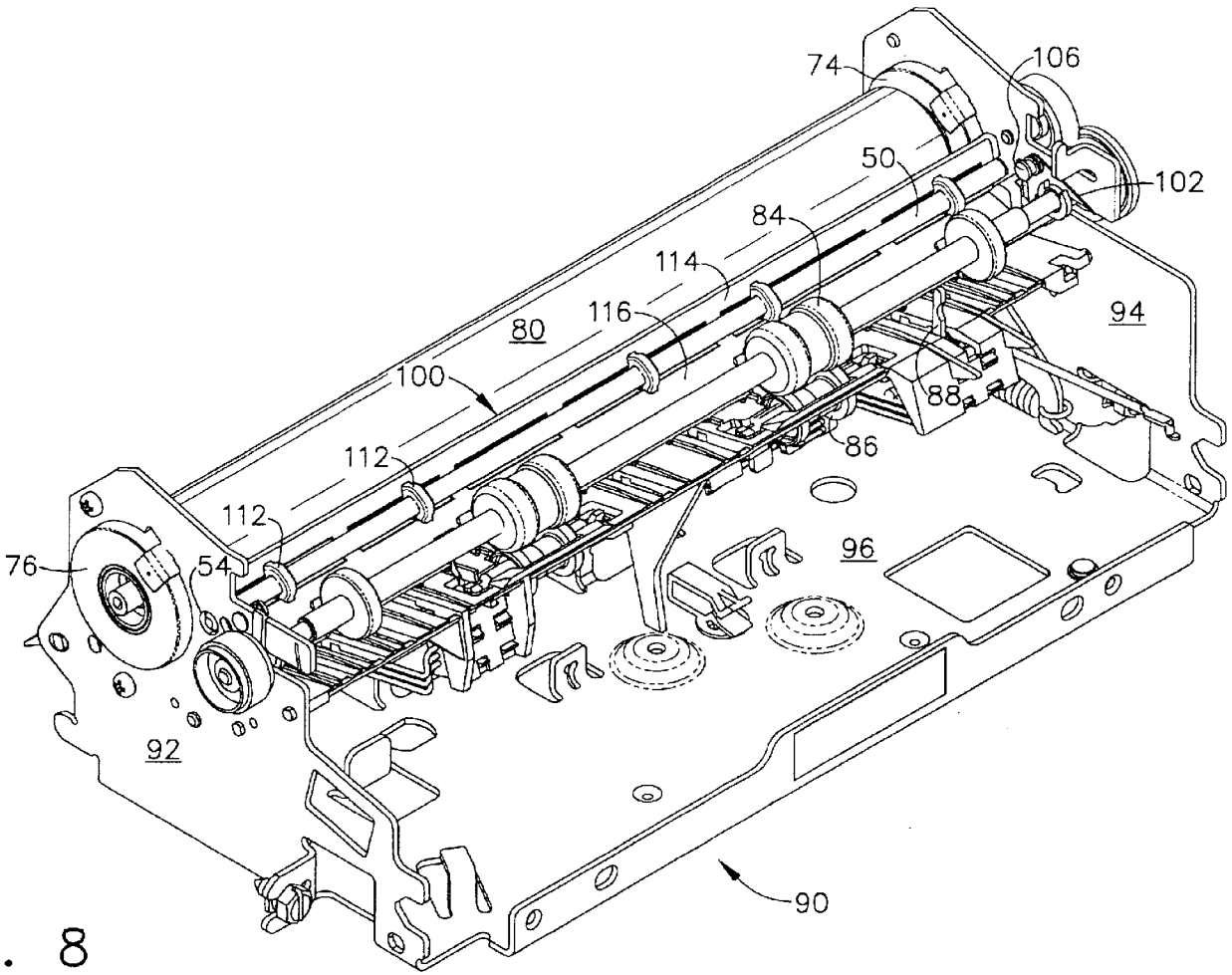
FIG. 8 is a perspective view from above and from one side, as well as from the exit end, of a fusing station of a fuser subassembly according to the present invention, which illustrates a second embodiment non-contact detack housing.

In detack housing 10, a mounting hole 24 is formed in a cylindrical member 22 that is found on each end of the detack housing 10. The mounting hole 24 is used to accurately mount the detack housing 10 within the fuser frame subassembly, so that the proper clearance will be obtained between the extended finger (not shown on FIG. 3) and the fuser hot roll (also not shown on FIG. 3). An alternative design for the detack housing is illustrated in FIG. 8, which is discussed below in greater detail. A pivot pin, or boss, 32 is visible on FIG. 3, which is placed into a locating slot of the fuser frame 60 (see FIG. 5). The housing locator boss 32 is illustrated near the intersection of the three arms or legs of the Y-shape of the detack housing 10. This locator boss is used to position the detack housing 10 within a slotted opening in the side members of the fuser frame (illustrated in FIGS. 5 and 6), and which is described in greater detail below. It should be noted that the detack housing 10 is pivotable about this locator boss 32, and its precise location will be locked in place by the positioning of a locking screw in the hole 24, after the detack housing has been placed within the fuser frame and biased against the bearings, as described below. (Note: the boss 32 also can slide within this slot, as well as pivot.) This housing positioning arrangement is used for both the first embodiment of the detack housing 10, as well as a second described embodiment that is first introduced in FIG. 8, and described below.

Figure 4:
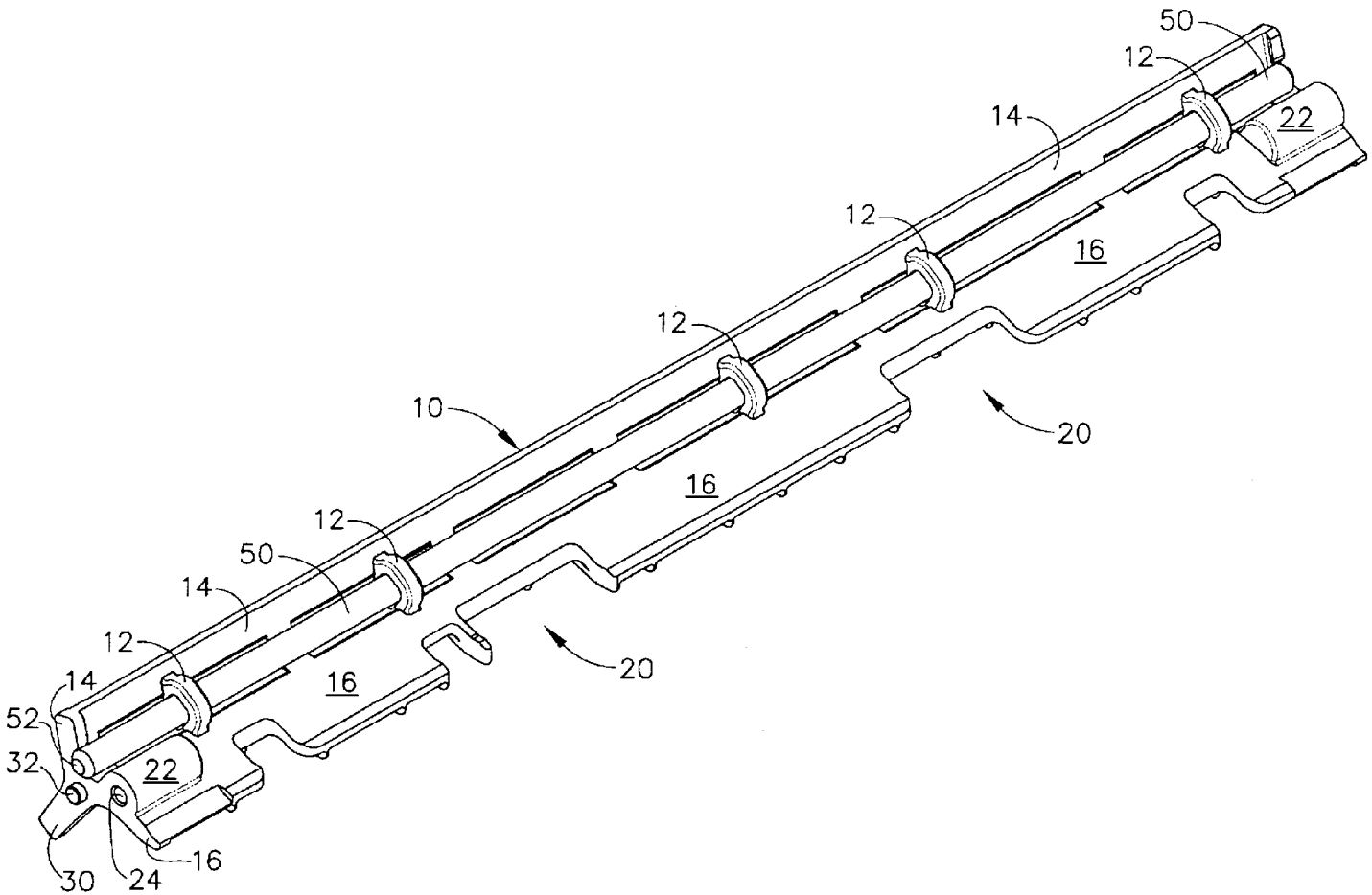
FIG. 4 is a perspective view of the first embodiment non-contact detack housing of FIG. 3, with the addition of a straightening rod.

FIG. 4 illustrates the same non-contact detack housing 10 with the addition of a straightening rod 50 that has been placed within the positioning loops 12. In a preferred mode of manufacture, the positioning rod 50 is made of a metallic material, such as steel or aluminum, and is pressed or slid through the openings in the positioning loops 12 until rod 50 is seated in its proper position as compared to the detack housing 10. However, it will be understood that any suitable material could be used for rod 50, including a steel shaft that has a molded plastic coating, or the rod 50 could be an insert in the mold that creates housing 10. The near end of rod 50 is illustrated at the reference numeral 52 on FIG. 4. In a preferred mode of the present invention, the positioning loops 12 are not perfectly circular even if the rod 50 is, and moreover, the inner surface of the positioning loops 12 is designed to slightly interfere with the outer surface of the rod 50 as it is pressed through the positioning loops 12. In this manner, the rod 50 is tightly held in place, and moreover will tend to put a beneficial stress on the overall detack housing 10 by causing the housing 10 to exhibit a more "straight" structure from left to right as viewed on FIG. 4.

Figure 5:
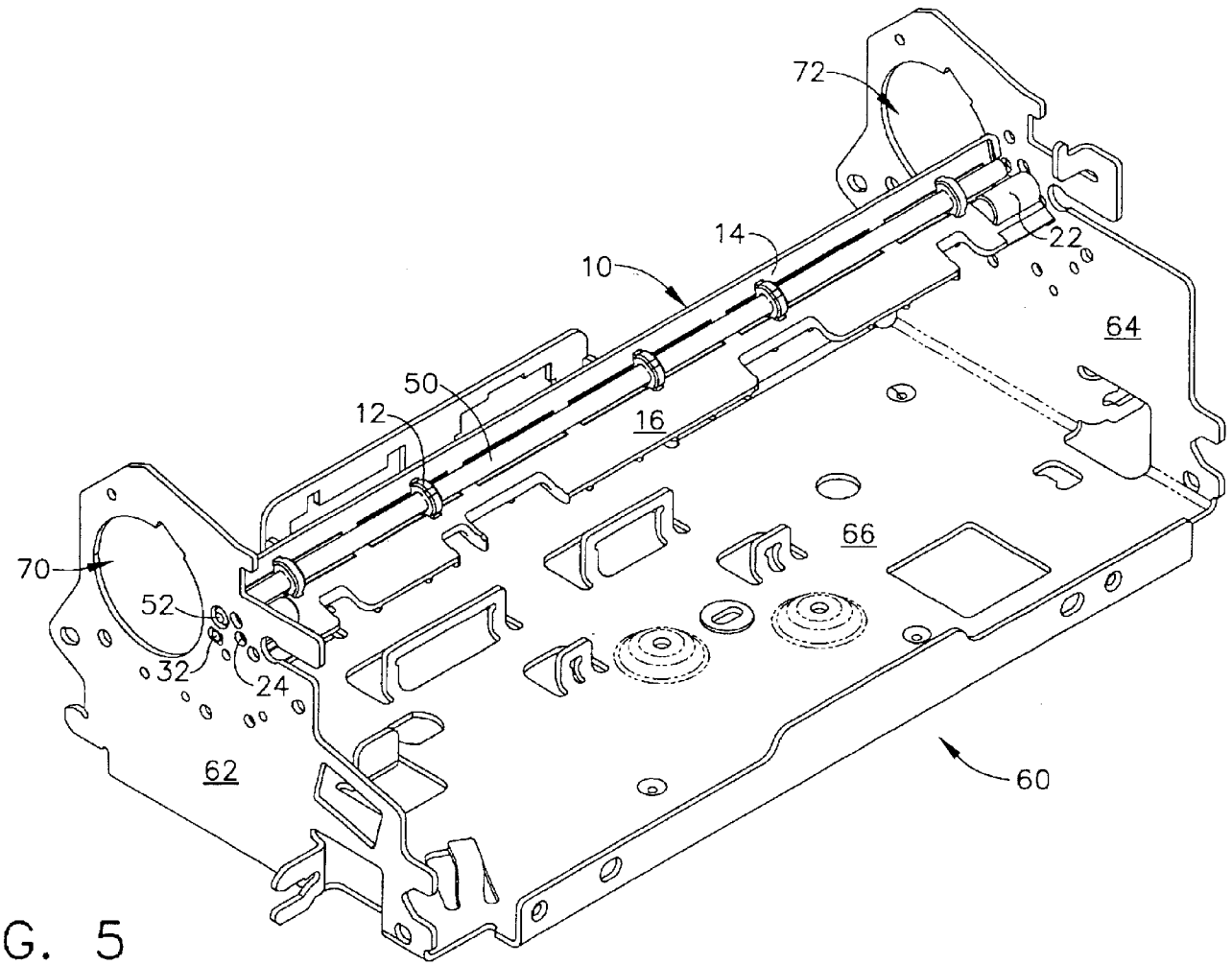
FIG. 5 is a perspective view from above, one side, and from the exit end of a fusing station, showing the first embodiment non-contact detack housing as it is positioned in a fuser frame, according to the principles of the present invention.

Referring now to FIG. 5, the fuser frame subassembly is illustrated, in which the fuser frame itself is generally depicted by the reference numeral 60. Fuser frame 60 includes a left (in this view) side member 62, a right (in this view) side member 64, and a bottom member 66. The non-contact detack housing 10 is positioned between the left and right members 62 and 64, in which the straightening rod 50 has its end element 52 positioned within an access hole of the left side member 62, as illustrated in FIG. 5. A similar end member of the rod 50 is located in a similar access hole in the right side element 64, but is not visible in this view. Rod 50 can actually be slid through these access holes for assembly, if desired. Alternatively, the rod 50 and housing 10 can first be mated together and then installed into the fuser frame as a sub-assembly, by mildly bending the side frames 62 and 64 outward during the installation step.

A further aid in correctly positioning the non-contact detack housing 10 is the use of a mounting hole 24 in the left side element 62, and a corresponding mounting hole in the right side element 64 that is not visible in this view. A locking screw (not shown) is placed through this mounting hole 24 and into the cylindrical mounting member 22 on each side of the detack housing 10. A mounting slot that holds the end 32 of the non-contact detack housing 10 and the locking screw placed at mounting hole 24 is one preferred methodology for locating the non-contact detack housing 10 at its correct position so that it will create the proper clearance between the detack fingers (not visible on FIG. 5) and the fuser hot roll (not shown on FIG. 5).

Openings in the fuser frame side members for placement of bearings are visible in FIG. 5. In the left side member 62 the opening is designated by the arrow 70. In the right side member 64, the opening is designated by the arrow 72.

Referring now to FIG. 6, the fuser frame subassembly 60 is again illustrated, this time from an opposite view as compared to FIG. 5. The fuser frame 60 again is depicted with its side members 62 and 64, along with its bottom member 66. The openings for the fuser hot roller bearings are again illustrated at 70 and 72.

The non-contact detack housing 10 is also visible in FIG. 6, and in this view a set of extending detack fingers at 26 are visible. As can be seen in FIG. 6, there are a total of five (5) detack fingers 26, although any number could be used, as preferred by the designer of the electrophotographic printer. The bottom ribs 18 are also visible in FIG. 6, and in general they extend from one side of the detack housing 10 to the other side. These are the same ribs 18 that were first illustrated in FIG. 3, although other shapes, numbers, and sizes of ribs 18 could be used without departing from the principles of the present invention.

The shape and dimensions of the illustrated detack fingers 26 are described below, and illustrated in greater detail in FIGS. 12 and 13. The fuser hot roll is omitted from FIG. 6 so that the detack fingers 26 can be seen, but in accordance with the principles of the present invention, these detack fingers 26 are not to make physical contact with the surface of the hot roll when the complete fuser subassembly is constructed. Of course, there are certain minimum and maximum clearance specifications between the gap that spaces-apart the detack fingers 26 and the surface of the fuser hot roll, and this is described below in reference to FIGS. 12–13.

Figure 7:
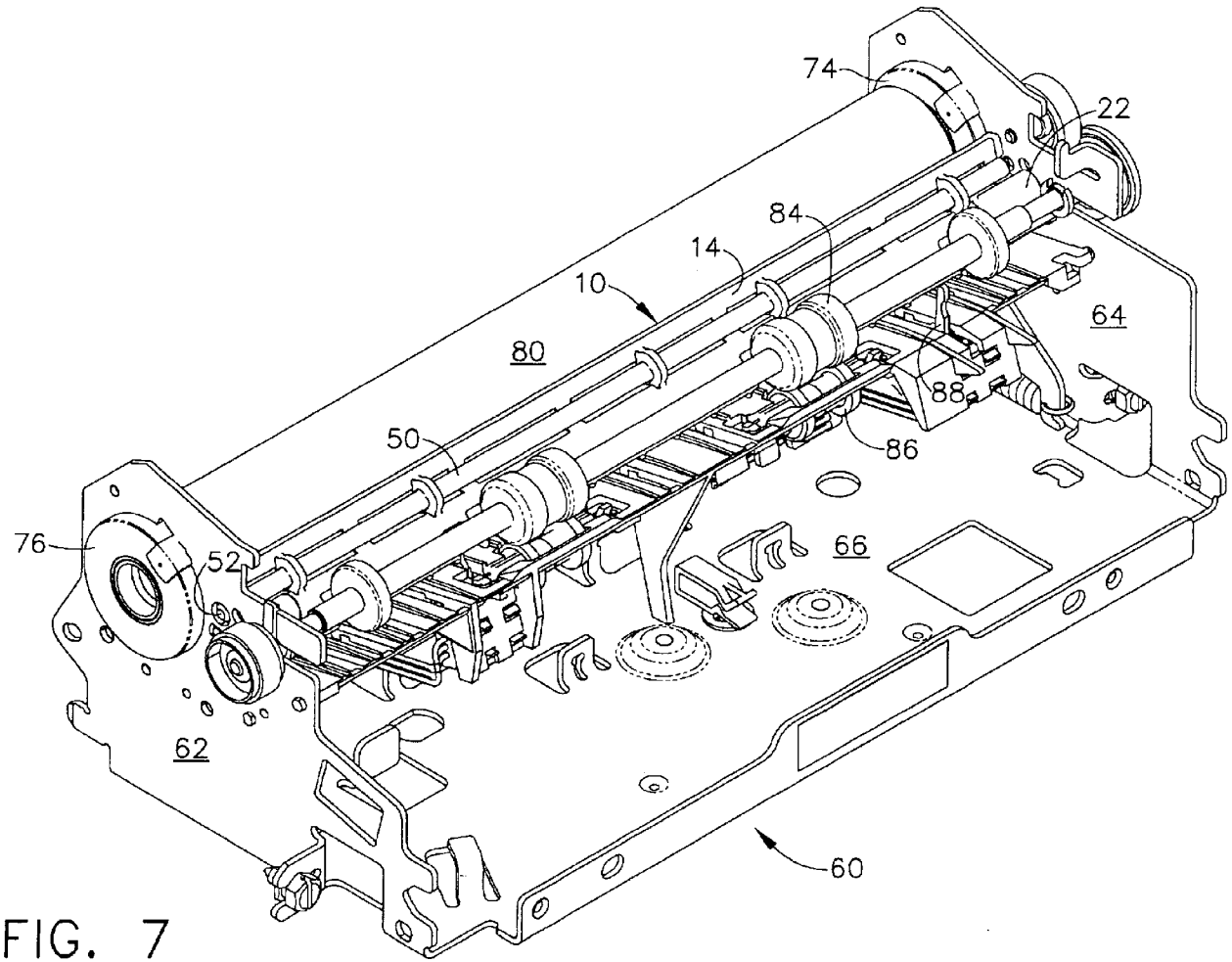
FIG. 7 is a perspective view from above and from the same side, but from the exit end of the fusing station of the fuser subassembly of FIG. 5, also showing the fuser hot roll and the exit rollers.

Referring now to FIG. 7, a more complete fuser subassembly is illustrated, in which a fuser hot roll 80 is positioned in close proximity to the non-contact detack housing 10. Fuser hot roll 80 is mounted by bearings 74 and 76 into the fuser frame 60 at its side walls (or side members) 62 and 64. Also visible on FIG. 7 are the two (2) exit rollers 84 and 86, as well as a fuser exit sensor at 88, which is spring-loaded to move out of the way of a sheet of print media as it leaves the nip between the exit rollers 84 and 86.

In FIG. 7, the first embodiment of a non-contact detack housing 10 is illustrated. Referring now to FIG. 8, an alternative or second embodiment of a non-contact detack housing is illustrated, and is generally depicted by the reference numeral 100. In FIG. 8, a second embodiment fuser subassembly is illustrated in the same detail as that of FIG. 7, and illustrates the fuser hot roll 80, its associated bearings 74 and 76, as well as the exit rollers 84 and 86. The exit sensor 88 is also illustrated.

The main difference between the fuser subassembly illustrated in FIG. 8 as compared to FIG. 7 is that a spring is used to help position the detack housing 100, rather than the use of a locking screw. Accordingly, the non-contact detack housing 100 is positioned by inserting its straightening rod 50 into an access hole at 54 and the left side member 92 of a fuser frame 90. A similar access hole is provided in the right side member 94 of the fuser frame 90. (Fuser frame 90 also has a bottom member at 96.) Instead of a locking screw, the detack housing 100 uses a spring having Y-shaped members which bias the housing 100 in predetermined locations against the outer surface of the side bearings 74 and 76, and this is illustrated in greater detail in FIGS. 10 and 11. One of the springs used to provide this spring-loading is illustrated in FIG. 8, and has an extending arm at 102, and is coiled about a post 106 that is part of the right side member 94 of the fuser frame 90.

The non-contact detack housing 100 is somewhat different from the first embodiment (depicted by the reference numeral 10 in FIG. 3), inasmuch as there are no cylinders 22 with mounting screw holes 24 in the second embodiment 100. The extending members 114 and 116 are somewhat different, although the positioning loops 112 are very similar or identical to the positioning loops 12 illustrated in FIG. 3. The straightening rod 50 can be identical, as it is held in place by the positioning loops 1 12.

In FIG. 8, the locator boss 32 cannot be seen, as it is hidden by one of the exit roller shaft gears that is mounted on the left side member 92. As in the first embodiment detack housing 10, the second embodiment detack housing 100 is both pivotable and slideable at the locator boss 32, and the spring loading will position the detack housing appropriately, as described below in greater detail.

Figure 9:
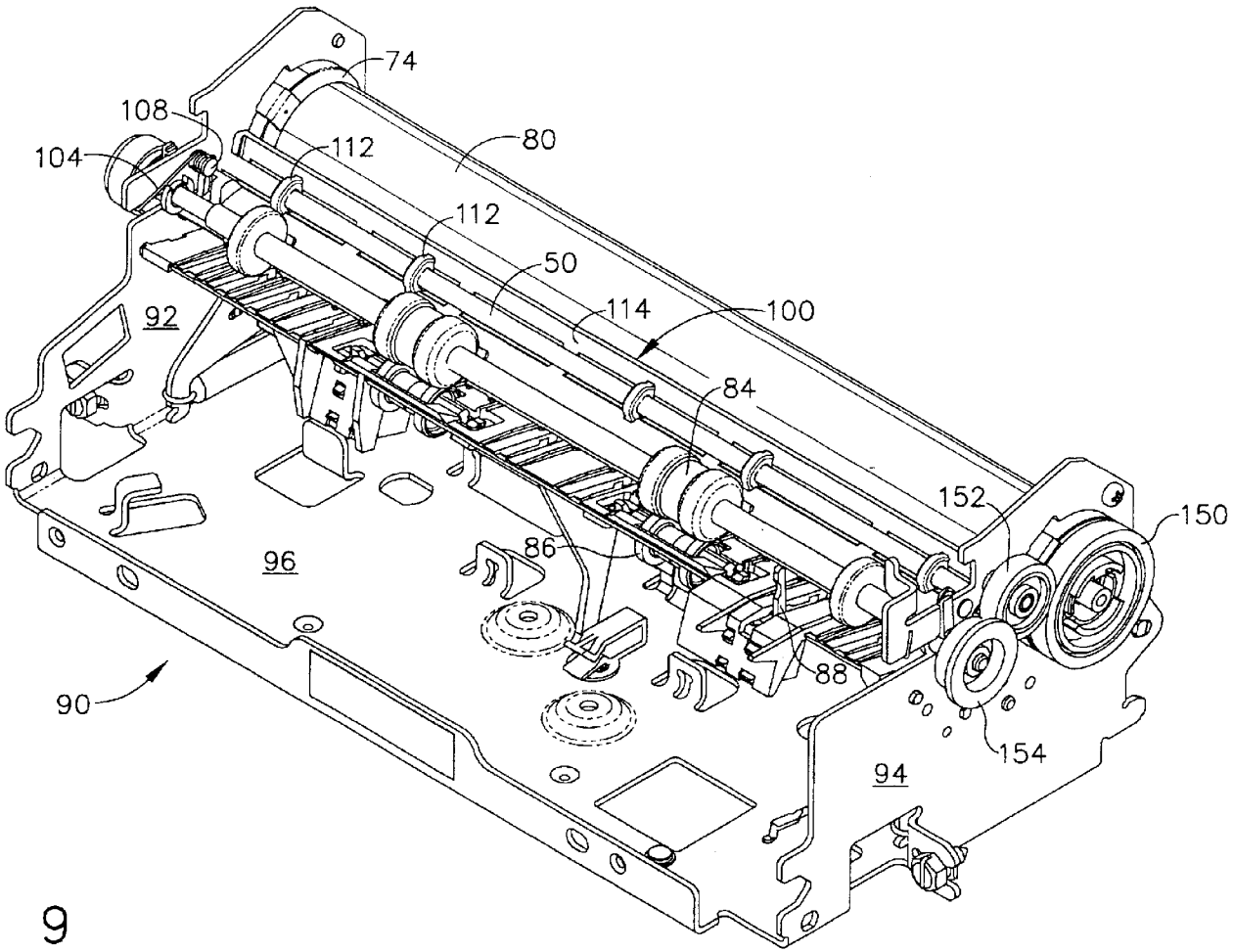
FIG. 9 is a perspective view from above and from the opposite side, but still from the exit end of the fusing station, of the second embodiment non-contact detack housing and fuser frame subassembly of FIG. 8.

Referring now to FIG. 9, the second embodiment detack housing 100 is again illustrated, and this time the opposite spring can be seen, having an extending arm 104, and having a coil wrapped around a post 108 on the opposite side member 94 of the fuser frame 90. In FIG. 9, the fuser hot roll 80, exit rollers 84 and 86, and exit sensor 88 are again visible. Further details of the fuser subassembly are visible in FIG. 9, including a fuser hot roll gear 150, an idler 152, and an exit roller shaft gear 154, which are all mounted to the side member 94.

Figure 10:
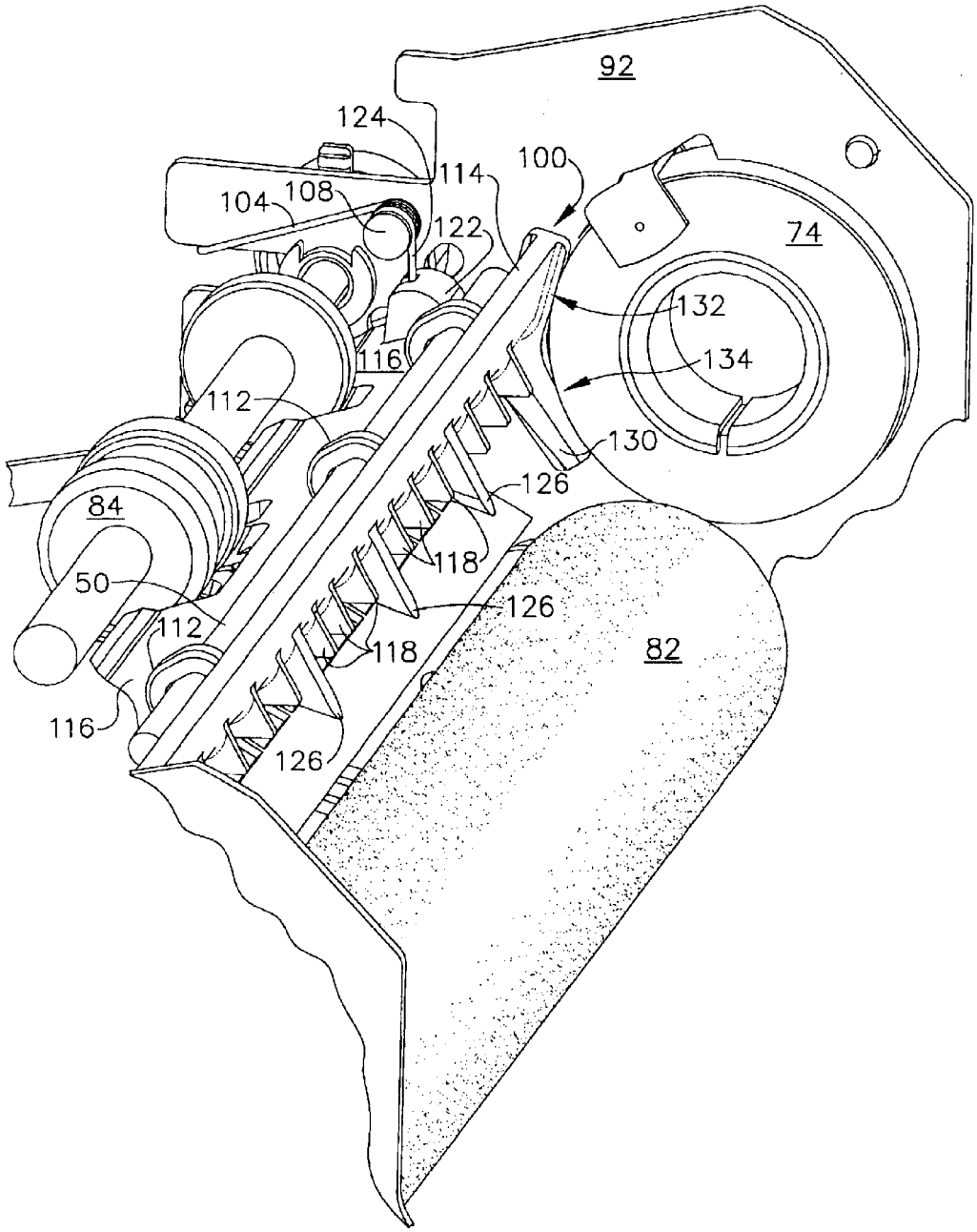
FIG. 10 is a close-up perspective view of a portion of the fuser subassembly illustrated in FIG. 9, but from an angle of the exit end of the fusing station, and still showing the second embodiment non-contact detack housing.

Referring now to FIG. 10, the detack fingers of the second embodiment detack housing 100 are visible, generally designated by the reference numerals 126. Some of the paper ribs, at 118, are also visible in FIG. 10, and the pressure roller 82 is visible since the hot roll has been omitted for purposes of clarity. The side bearing 74 is illustrated in this view, as mounted to the side member 92 of the fuser frame 90.

In FIG. 10, further details of the spring that is mounted to the post 108 are illustrated, in which a first extending arm 104 is illustrated as extending to the left of the mounting post 108, and a second extending arm 124 is illustrated as mounting downward into a receptacle 122 which is part of the second embodiment detack housing 100. The leftward extending arm 104 has a hook-type structure that is wrapped around a portion of the side member 94 of the fuser frame 90, and this anchors the spring in place so that when its opposite downward-extending member 124 is placed into a slot of the receptacle 122, it creates a force that tends to push the detack housing 100 to the right as seen in this view of FIG. 10. When this biasing occurs, the downward leg of the Y-shaped detack housing 100, which is designated by the reference numeral 130, is pressed against the outer diameter of the bearing 74, while the upward extending arm 114 of the Y-shaped detack housing 100 is also pressed against the bearing outer diameter. The two (2) points where contact is made between the detack housing 100 and the bearing 74 are designated by the arrows 132 and 134, for the members 114 and 130, respectively.

Figure 11:
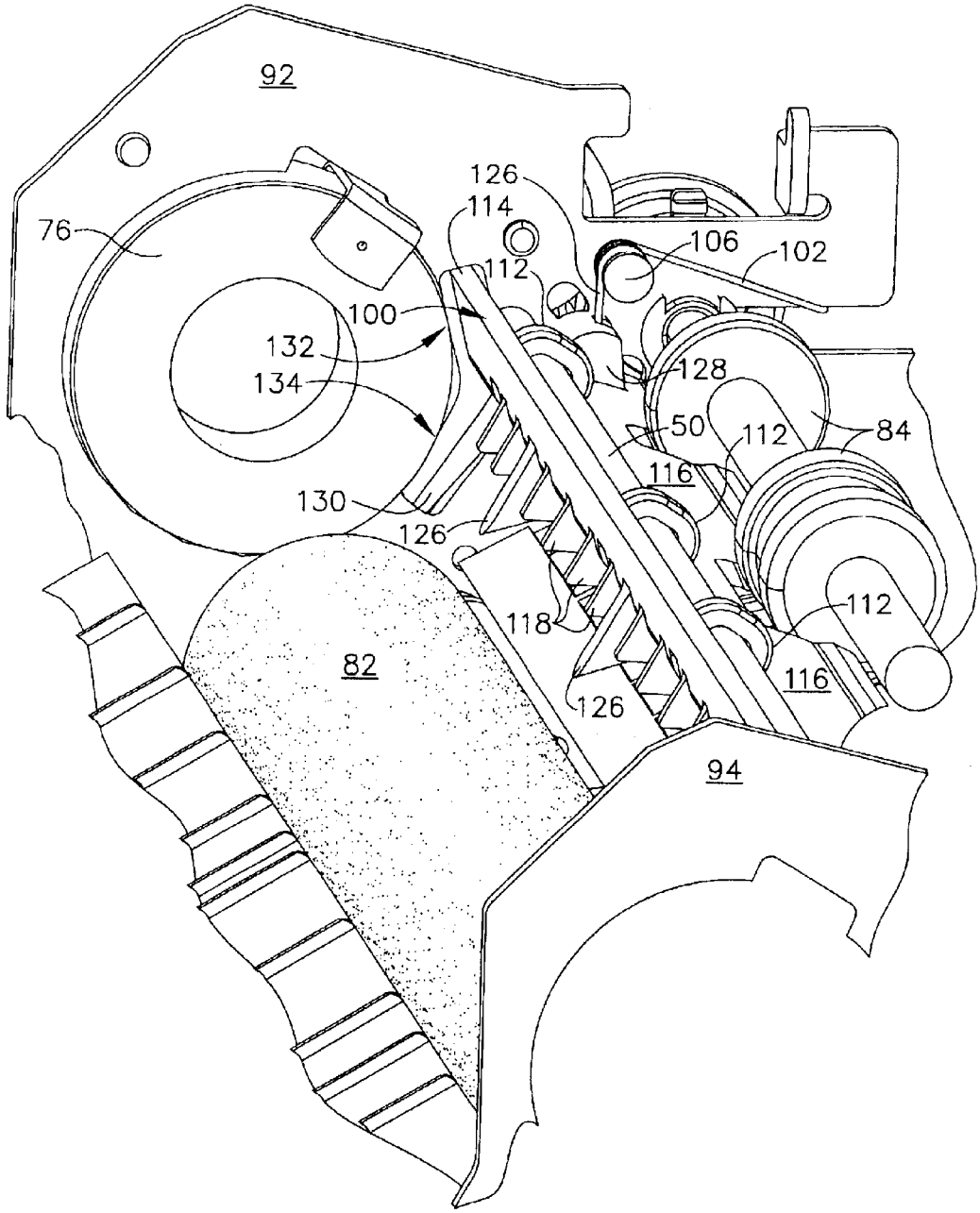
FIG. 11 is another close-up perspective view of the opposite end from FIG. 10 of the same detack housing of FIG. 10.

Referring now to FIG. 11, a similar view is seen of the opposite end of the detack housing 100 as it is mounted against the opposite side member 92 of the fuser frame 90. A second spring is located on the side member 92, and it has a first extending arm 102 which extends to a coil that is wrapped around the post 106. Its second extending arm is designated at the reference numeral 126, which is placed in a slot of a receptacle member 128 of the second embodiment non-contact detack housing 100. In a similar fashion to the other spring having arms 104 and 124 illustrated in FIG. 10, the second spring having arms 104 and 126 will also bias the detack housing 100 against the outer diameter of the bearing 76 that is mounted on the side member 92. Contact is made at two points, again designated by the arrows 132 and 134, respectively, for the points of contact of the arm 114 and the arm or leg 130 of the detack housing 100.

In FIG. 11, the other detack fingers 126 and some of the other paper ribs 118 are illustrated, as well as the top exit roller 84. Similar to the illustration of FIG. 10, the pressure roller 82 is illustrated in FIG. 11, however, the fuser hot roll has been omitted for clarity.

Figure 12:
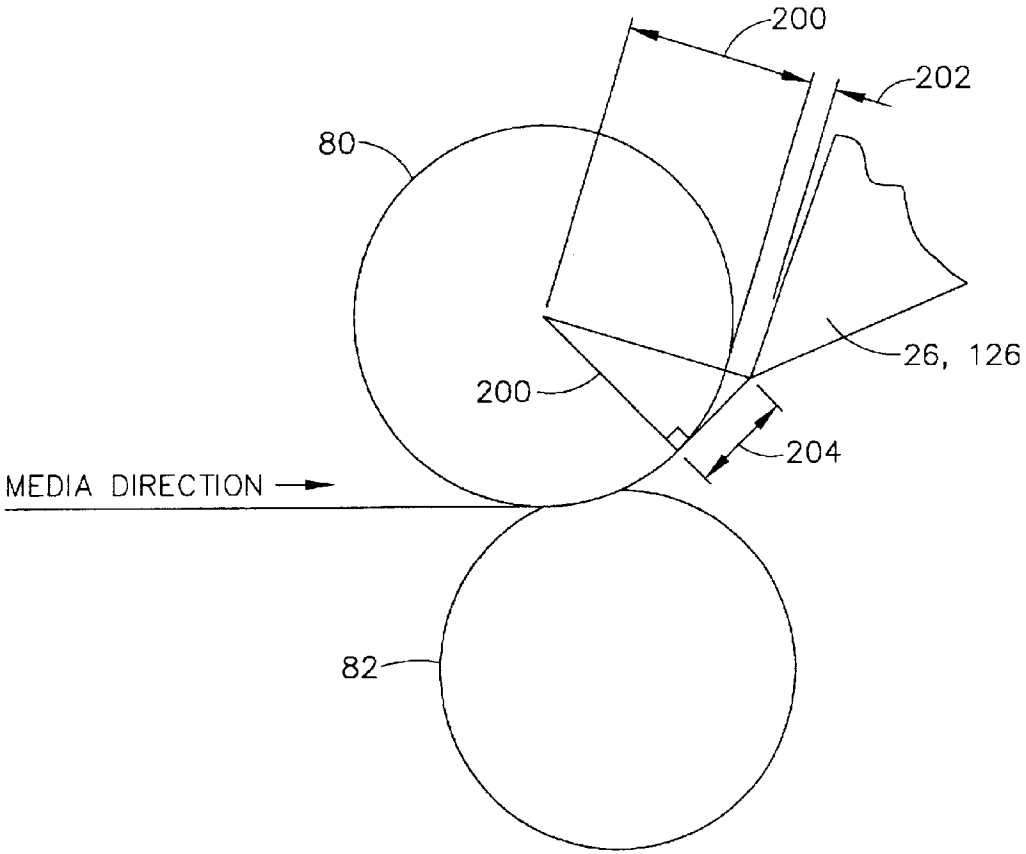
FIG. 12 is a diagrammatic view from one side of a fuser hot roll showing the geometry involved in locating a detack member of the present invention, but not to scale.

Referring now to FIG. 12, the geometry of the fuser hot roll 80 and pressure roller 82 is illustrated with respect to the placement of the detack finger 26, or 126, depending upon which detack housing is used. A more detailed view of this orientation is provided in FIG. 13, however, FIG. 12 will be discussed first (which is not to scale).

In FIG. 12, the print media approaches from the left in this view, and is directed through a nip formed by the fuser hot roll 80 and the pressure roller 82. FIG. 12 shows an interference between these two rolls, and in actuality, the pressure roll 82 is coated with a soft outer material for a thickness of approximately 5 mm, which deforms while applying pressure against the media, which causes the media to be pressed against the fuser hot roll 80 at this nip.

As the media traverses through the nip and begins to exit the nip to the right as seen in FIG. 12, the leading edge of the media may not significantly separate from the fuser hot roll very easily. Hence the reason for the prior art contact detack fingers, which are used to ensure that the leading edge of the media actually separates from the fuser hot roll 80. In the present invention, the non-contact detack fingers 26 or 126 will perform this function while nevertheless having a clearance at the dimension 202 on FIG. 12. However, to ensure that the leading edge of the print media will separate at least a small amount, it is important that there be a small amount of distance from the leading edge of the print media that has no toner applied; this distance is referred to as the "top margin" of the page. In the present invention, this will be a very small distance, but it nevertheless should be maintained to ensure that the non-contact detack fingers 26 or 126 will be able to successfully separate the print media from the fuser hot roll 80.

One concept of the non-contact detack design revolves around the Pythagorean theorem and its application to the geometry at which the media comes out of the fuser nip between the hot roll 80 and the pressure roller 82. Stress testing has demonstrated that a minimum allowable top margin of the print media is important to the design of a non-contact detack system, due to the toner sticking to the fusing roll in the printed area under certain conditions. If the minimum top margin of the print media can be controlled, then from the Pythagorean theorem it can be shown that there is a correlation between the minimum top margin and the maximum allowable clearance of a non-contact detack system. This hypothesis assumes that toner sticks to the fusing hot roll 80 and that the unprinted top margin is at a tangent (for small distances) to the fusing hot roll upon exiting the fuser nip. The hypothesis has been tested and proven to be an adequate description of media exit from the fuser nip when toner is printed to the minimum top margin. FIG. 12 shows a schematic or diagrammatic view of this principle.

The radius of the fuser hot roll 80 is given by the dimension at 200, and the dimension from the intersection of the radius 200 and the leading edge of the detack fingers, at a right angle to the radius 200, is given by the dimension 204. The hypotenuse of this right triangle has the dimension of the radius 200 plus a clearance gap 202. The dimension 204 represents the minimum top margin of the sheet of print media, and toner should not be applied within this distance along the leading edge of a particular sheet so as to ensure an initial separation between the leading edge of the print media and the fuser hot roll 80. Dimension 202 represents the clearance gap between the leading edge of the detack finger 26 or 126, which also is illustrated by the arrow 202 on FIG. 13.

According to the Pythagorean theorem, and in order to guarantee proper media diversion from the fuser hot roll 80, the relationship between the fuser hot roll radius, the minimum top margin, and the maximum allowable clearance between the detack finger and the outer diameter of the fuser hot roll is as follows:

$$FRR^2+MTM^2>(FRR+MDC)^2$$

where:

FRR—Fusing Roll Radius

MTM—Minimum top Margin (Printer Spec)

MDC—Maximum Allowable Detack Clearance to Guarantee Media/Roller Separation

As an example of the type of dimensions used in conjunction with the present invention, the maximum allowable detack clearance can be calculated for an example fuser hot roll having a 30.3 mm diameter (which is typical for a Lexmark fuser hot roll), and in which the printed top margin can, for example, be as small as 4.3 mm (which is typical for a Lexmark laser printer). The above equation will provide the following numeric results:

$$\text{Substituting: } 15.15^2+4.3^2>(15.15+MDC)^2 MDC<0.6 \text{ mm}$$

The most robust design would be such that the maximum detack clearance (with location and tolerances) would always strip the minimum top margin that is allowed to be printed by the printer. The maximum allowable non-contact detack clearance that must be designed in order to guarantee that a sheet of print media having a minimum top margin of 4.3 mm will always be diverted out of the fuser using the above dimensions is <0.6 mm.

When the designed minimum top margin becomes fairly small, the design theory of the present invention (based on the Pythagorean theorem) can cause the maximum allowable non-contact detack clearance to become extremely small. At this point, action must be taken to ensure that the non-contact detack system maintains minimal tolerances and can be held at a very close locational proximity to the fusing roll 80. In order to incorporate these requirements, a one-piece plastic detack housing design can provide some very unique locating features. As discussed above, the one-piece plastic non-contact detack housing can hold very tight tolerances because it uses a straightening rod 50 to eliminate part bow, and its position is tightly controlled with respect to the fuser roll bearings 74, 76, either by being tightened in contact with the bearing, or by being spring-loaded into the bearing.

Figure 13:
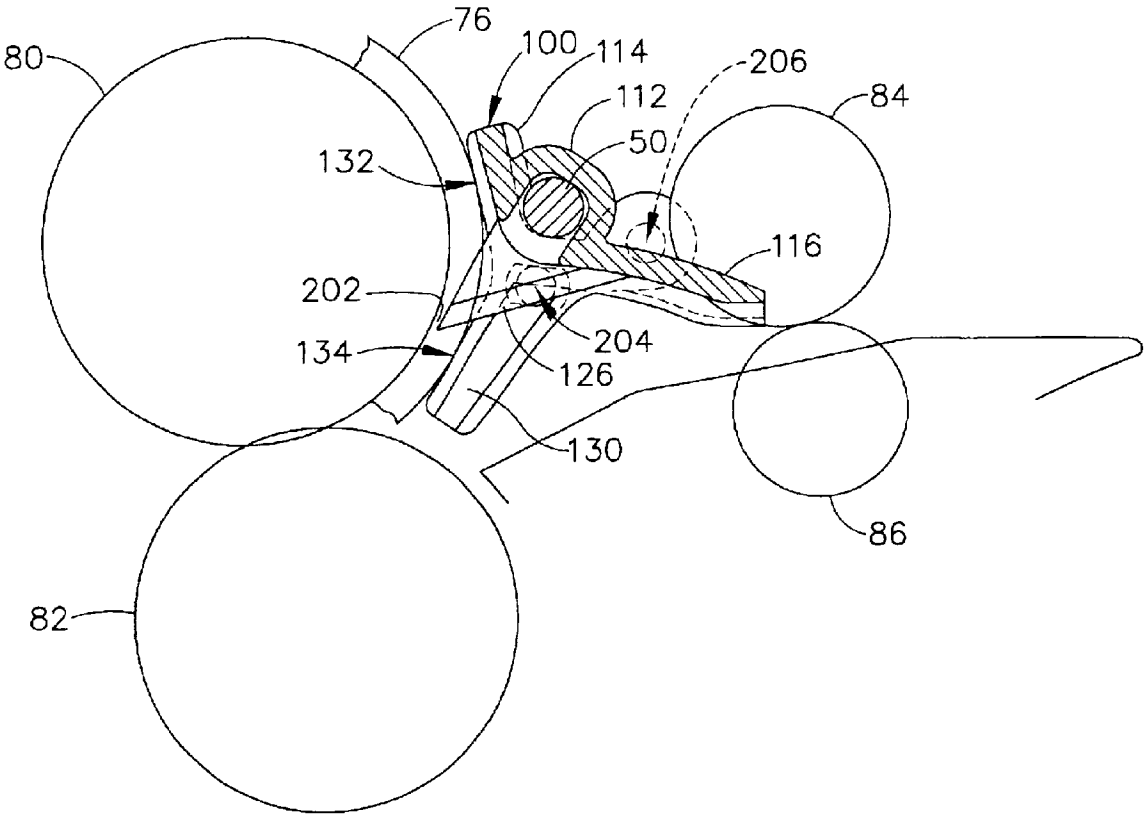
FIG. 13 is a side view from the same side as illustrated in FIG. 12 of the non-contact detack housing as it is positioned against a bearing of the hot roll, as used in the present invention.

Referring now to FIG. 13, a detailed example of the shapes of one of the embodiments of the detack housing is provided from an end view. The fuser hot roll 80 is depicted as being in interference contact with its pressure or backup roll 82. The outer diameter of one of the bearings 76 is illustrated as being in contact with the detack housing 100 at the point 132, with respect to the member 114. With respect to the member 130, the detack housing 100 makes contact at the point 134. The other member 116 of detack housing 100 extends towards the exit rollers 82 and 86, and its bottom surface can provide the ribs illustrated on the earlier figures.

The detack finger itself is illustrated at 126, and has a proximal end or tip near the gap at 202, as noted above. By careful positioning of the detack housing, the gap 202 formed between the tip and the outer diameter of the fuser hot roll 80 can be tightly controlled, thereby ensuring separation of the print media from the fuser hot roll 80. This careful positioning can either be accomplished by a spring-loading of a pivotable and slideable detack housing, or by use of a locking screw that also will hold the detack housing in its preferred location. The straightening rod 50 also performs an important role, although it would not be entirely necessary to use a straightening rod if the detack housing was made of a material that was sufficiently stiff, and could be economically manufactured of sufficient straightness to eliminate the need for a separate rod. At the time of invention, the preferred material for the rod is steel, and preferred material for the detack housing is moldable plastic. The bearings preferably comprise steel ball-bearings, although any type of bearing could be used if desired. Moreover, the fuser frame is preferably made of sheet metal, but again any desired, suitable material could be used.

On FIG. 13, a point 204 represents the location of the boss 32 of the detack housing. Also on FIG. 13, a point 206 represents a location of a locking screw that would be used in the first embodiment detack housing 10, or such a location could be any place along the surface of the detack housing, if desired.

It will be understood that the non-contact detack finger design of the present invention can be used on any hot roll fuser design. Both color and mono laser printer products can benefit from this design, and are encompassed by the present invention.

With the removal of the prior art "contact" detack fingers from the fuser hot roll, print quality will be improved by omission of residual detack streaks on paper and transparencies, and by elimination of detack finger toner dumps at start-up. These prior art deficiencies have especially been a problem with long print jobs of high coverage.

Since there are no contacting detack fingers exerting a normal force on the hot roll in the present invention, the Teflon® coating on the fuser hot roll is not worn. Therefore, the life of the fuser hot roll is extended. This should decrease the warranty costs associated with printing machines that incorporate the present invention.

Regardless of the type of toner used in the printer, contamination of the non-contact detack fingers is eliminated. Additionally, when toner formulation is changed, it has constantly been a development work item to get the prior art contact detack finger material to properly work with the toner. With the non-contact detack design of the present invention, toner formulation is no longer a concern with regard to detack contamination, which allows for more flexibility in toner formulation and should involve less work in fuser design and development. Therefore, the present invention should reduce the product development cycle with regard to fuser testing and later design changes that otherwise might be needed to accommodate toner collection on the older "contact" detack fingers. History shows that excessive toner accumulation also causes fuser accordion jams as well as premature hot roll fuser life.

In many prior art fusers, one or more of the detack fingers are often dislodged by customers attempting to remove paper jams within the fuser. In doing so, an accordion jam will occur on the next page through the fuser, which typically results in a need for a field repair to the printer. With the removal of detack fingers, customers will not experience accordion jams due to toner contamination of detack fingers (i.e., growth of toner on detacks), which should decrease field repairs and customer complaints.

By use of non-contact detack fingers, a conductive sleeve fuser hot roll could be used, if desired. Such a design should eliminate "white line defect" print quality problems presently experienced on convention EP printing products. A conductive hot roll coating may be desirable to eliminate electrostatic build-up on the fuser hot roll which, when that occurs, can cause the "white line" defect, and other problems. Hot roll wear has been a problem with conductive coatings in the past, but would not be a concern when the non-contact detack fingers of the present invention are used.

With fewer parts required, less assembly effort is needed. Additionally, less space is required for the production of fusers by eliminating the conventional detack finger cells, which require greater space. Furthermore, cost of manufacture should be reduced using the non-contact detack housing, which includes detack fingers, detack springs, and the upper exit guide, all molded into a one piece non-contact upper exit guide. The only other pieces required are used for locating and straightening the non-contact detack housing, as described above.

It will be understood that the term "print media" herein refers to a sheet or roll of material that has toner or some other "printable" material applied thereto by a print engine, such as that found in a laser printer, or other type of electrophotographic printer. Print media is sometimes referred to as "print medium," and both terms have the same meaning with regard to the present invention, although the term print media is typically used in this patent document. Print media can represent a sheet or roll of plain paper, bond paper, transparent film (often used to make overhead slides, for example), or any other type of printable sheet or roll material.

It will also be understood that the term "fuser hot roll" is also referred to as a "fuser" by many, although an entire fuser subassembly can incorporate other components, as described in this patent document. As used herein, the fuser subassembly includes other rollers, such as a pressure or backup roller, and one or more exit rollers. In addition, the fuser subassembly of the present invention also includes gears, bearings, a "fuser frame," as well as a non-contact detack housing. The non-contact "detack housing" itself includes at least one detack "finger" and a set of ribs, as well as other structures used to properly position the detack housing within the fuser subassembly.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

The invention claimed is:

1. An image forming fuser apparatus, comprising:

a fuser hot roll and a pressure roll, wherein said fuser hot roll and said pressure roll form a nip therebetween; and a detack structure that is spaced-apart from said fuser hot roll, said detack structure comprising at least one extension proximal to said fuser hot roll such that a clearance gap is formed between said at least one proximal extension and said fuser hot roll;

wherein said detack structure is positioned so as to ensure separation of a print media from said fuser hot roll after said print media travels through said nip, by use of said at least one proximal extension, and wherein said clearance gap is held to a distance within a predetermined maximum tolerance by controlling an orientation between a bearing of said fuser hot roll and said detack structure.

2. The fuser apparatus as recited in claim 1, wherein said detack structure is spring-loaded so as to cause at least one member of said detack structure to make physical contact with said bearing, thereby ensuring that said controlled orientation is maintained so as to provide said clearance gap between said at least one proximal extension and said fuser hot roll.

3. The fuser apparatus as recited in claim 2, further comprising at least one spring that makes contact with said detack structure and a fuser frame, wherein said at least one spring biases said detack structure against said bearing.

4. The fuser apparatus as recited in claim 1, wherein said detack structure is positioned by use of a locking screw so as to cause said controlled orientation to be maintained so as to provide said clearance gap between said at least one proximal extension and said fuser hot roll.

5. The fuser apparatus as recited in claim 4, wherein said locking screw is placed through a first mounting hale in a fuser frame, and into a second mounting hole in said detack structure.

6. The fuser apparatus as recited in claim 1, wherein said fuser hot roll and said pressure roll are incorporated in an electrophotographic printer that produces a physical output upon said print media.

7. An image forming fuser apparatus, comprising:

a fuser hot roll and a pressure roll, wherein said fuser hot roll and said pressure roll form a nip therebetween; and a detack structure that is spaced-apart from said fuser hot roll, said detack structure comprising at least one extension proximal to said fuser hot roll such that a clearance gap is formed between said at least one proximal extension and said fuser hot roll;

wherein said detack structure is positioned so as to ensure separation of a print media from said fuser hot roll after said print media travels through said nip, by use of said at least one proximal extension, and wherein said clearance gap is substantially related to a top margin of said print media as follows:

$$FRR^2+MTM^2>(FRR+MDC)^2;$$

wherein:

FRR represents a radius of said fuser hot roll;

MTM represents a top margin of said print media within which toner is not affixed; and MDC represents a distance allowed for said clearance gap.

8. The fuser apparatus as recited in claim 7, wherein said fuser hot roll and said pressure roll are incorporated in an electrophotographic printer that produces a physical output upon said print media.

9. An image forming fuser apparatus, comprising:

a fuser hot roll and a pressure roll, wherein said fuser hot roll and said pressure roll form a nip therebetween; and a detack structure that is spaced-apart from said fuser hot roll, such that a clearance gap is formed therebetween;

wherein said detack structure is positioned such that said clearance gap exhibits a predetermined distance, thereby ensuring separation of a print media from said fuser hot roll after said print media travels through said nip, and wherein said clearance gap is substantially related to a top margin of said print media as follows:

$$FRR^2+MTM^2>(ERR+MDC^2;$$

wherein:

ERR represents a radius of said fuser hot roll;

MTM represents a top margin of said print media within which toner is not affixed; and MDC represents a distance allowed for said clearance gap.

10. The fuser apparatus as recited in clam 9, wherein said detack structure comprises at least one extension proximal to said fuser hot roll such that said clearance gap is formed between said at least proximal extension and said fuser hot roll.

11. The fuser apparatus as recited in claim 9, wherein said fuser hot roll and said pressure roll are incorporated in an electrophotographic printer that produces a physical output upon said print media.

12. An image forming fuser apparatus, comprising:

a fuser hot roll and a pressure roll, wherein said fuser hot roll and said pressure roll form a nip therebetween; and a detack structure that is spaced-apart from said fuser hot roll, such that a clearance gap is formed therebetween;

wherein said detack structure is positioned such that said clearance gap exhibits a predetermined distance, thereby ensuring separation of a print media from said fuser hot roll after said print media travels through said nip, and wherein said clearance gap is held to a distance within a predetermined maximum tolerance by controlling an orientation between a beating of said fuser hot roll and said detack structure.

13. The fuser apparatus as recited in claim 12, wherein said detack structure is spring-loaded so as to cause at least one member of said detack structure to make physical contact with said bearing, thereby ensuring that said controlled orientation is maintained so as to provide said clearance gap between said detack structure and said fuser hot roll.

14. The fuser apparatus as recited in claim 13, further comprising at least one spring that makes contact with said detack structure and a fuser frame, wherein said at least one spring biases said detack structure against said bearing.

15. The fuser apparatus as recited in claim 12, wherein said detack structure is positioned by use of a locking screw so as to cause said controlled orientation to be maintained so as to provide said clearance gap between said detack structure and said fuser hot roll.

16. The fuser apparatus as recited in claim 15, wherein said locking screw is placed through a first mounting hole in a fuser frame, and into a second mounting hole in said detack structure.

17. The fuser apparatus as recited in claim 12, wherein said detack structure comprises at least one extension proximal to said fuser hot roll such that said clearance gap is formed between said at least one proximal extension and said fuser hot roll.

18. The fuser apparatus as recited in claim 12, wherein said fuser hot roll and said pressure roll are incorporated in an electrophotographic primer that produces a physical output upon said print media.

19. A method for separating a print media from a fuser hot roll in an image forming apparatus, said method comprising:

providing a fuser hot roll and a pressure roll, wherein said fuser hot roll and said pressure roll form a nip therebetween;

directing a print media through said nip while rotating said fuser hot roll and said pressure roll; and separating said print media from said fuser hot roll by use of a non-contact detack structure, while maintaining a clearance gap within a predetermined distance between said non-contact detack and said fuser hot roll, wherein said clearance gap is substantially related to a top margin of said print media as follows:

$$FRR^2+MTM^2>(FRR+MDC)^2;$$

wherein:

FRR represents a radius of said fuser hot roll;

MTM represents a top margin of said print media within which toner is not affixed; and MDC represents a distance allowed for said clearance gap.

20. The method as recited in claim 19, wherein said detack structure comprises at least one extension proximal to said fuser hot roll such that said clearance gap is formed between said at least one proximal extension and said fuser hot roll.

21. The method as recited in claim 19, wherein said fuser hot roll and said pressure toll are incorporated in an electrophotographic printer that produces a physical output upon said print media.

22. A method for separating a print media from a fuser hot roll in an image forming apparatus, said method comprising:

providing a fuser hot roll and a pressure roll, wherein said fuser hot roll and said pressure roll form a nip therebetween;

directing a print media through said nip while rotating said fuser hot roll and said pressure roll; and separating said print media from said fuser hot roll by use of a non-contact detack structure, while maintaining clearance gap within a predetermined distance between said non-contact detack and said fuser hot roll, wherein said clearance gap is held to a distance within a predetermined maximum tolerance by controlling an orientation between a bearing of said fuser hot roll and said detack structure.

23. The method as recited in claim 22, wherein said detack structure is spring-loaded so as to cause at least one member of said detack structure to make physical contact with said bearing, thereby ensuring that said controlled orientation is maintained so as to provide said clearance gap between said detack structure and said fuser hot roll.

24. The method as recited in claim 23, further comprising at least one spring that makes contact with said detack structure and a fuser frame, wherein said at least one spring biases said detack structure against said bearing.

25. The method as recited in claim 22, wherein said detack structure is positioned by use of a locking screw so as to cause said controlled orientation to be maintained so as to provide said clearance gap between said detack structure and said fuser hot roll.

26. The method as recited in claim 25, wherein said locking screw is placed through a first mounting hole in a fuser frame, and into a second mounting hole in said detack structure.

27. The method as recited in claim 22, wherein said detack structure comprises at least one extension proximal to said fuser hot roll such that said clearance gap is formed between said at least one proximal extension and said fuser hot roll.

28. The method as recited in claim 22, wherein said fuser hot roll and said pressure roll are incorporated in an electrophotographic printer that produces a physical output upon said print media.

* * * * *